United States Patent [19]

Dünker et al.

[11] Patent Number: 4,607,505

[45] Date of Patent: Aug. 26, 1986

[54] HAND NEEDLE FOR KNITTING OR CROCHET

[75] Inventors: Friedrich W. Dünker, Altena; Walter Ossenberg-Engels, Iserlohn, both of Fed. Rep. of Germany

[73] Assignee: Joh. Moritz Rump, Altena, Fed. Rep. of Germany

[21] Appl. No.: 794,239

[22] Filed: Nov. 1, 1985

[30] Foreign Application Priority Data

Nov. 13, 1984 [DE] Fed. Rep. of Germany ..... 3441400

[51] Int. Cl.[4] ..... D04B 35/02

[52] U.S. Cl. ..... 66/117; 66/1 A

[58] Field of Search ..... 66/116, 1 A, 117, 118

[56] References Cited

U.S. PATENT DOCUMENTS

| | | | |
|---|---|---|---|
| 2,234,061 | 3/1941 | Porter et al. | 66/117 |
| 2,309,528 | 1/1943 | Otting et al. | 66/117 |
| 2,668,429 | 2/1954 | Barsky | 66/117 |

*Primary Examiner*—Ronald Feldbaum

*Attorney, Agent, or Firm*—Michael J. Striker

[57] ABSTRACT

A needle for knitting or crochet includes a needle tip of a material resistant to bending and a flexible loop-receiving rod secured to the rear end of the needle tip. A node is provided at the rear end of the loop-receiving rod. The needle includes a loop braking element slidable positioned on the rod. The node precludes the loop braking element from slipping off the rod. The loop braking element is a ring or a disk formed with a radial bore receiving the rod therethrough and a recess in which the end of the rod can be snapped.

7 Claims, 5 Drawing Figures

1
2
3
4
5
6a
6b
6c
7
40
50
60

HAND NEEDLE FOR KNITTING OR CROCHET

BACKGROUND OF THE INVENTION

The present invention relates to a hand knitting or crochet needle which is normally comprised of a metal or plastic tip operating as a needle and an elongated flexible loop-receiving rod or shaft which is preferably of the diameter smaller than that of the tip.

Various modifications of hand needles of the type under consideration, made in the form of knitting needles or crochet needles have been known. The tip of such a needle is normally made of metal, such as steel, brass, aluminum, or synthetic plastic material. The loop-receiving rod or shaft formed, for example of NYLON cord or wire is secured to the rear narrowing end of the working tip. The loop-receiving rod is easily bendable due to its elasticity so that although the greatest bending radius of the rod is relatively large the rod itself is of such stiffness that the manipulation of the needle is not influenced.

The advantage of such conventional hand knitting or crochet needles resides in that such needles are not very bulky and that the knitted or crocketted portion does not hang with its entire weight at the rear end of the needle so that working with such needles is not difficult though the knitted portion usually rests on the ground or on the lap of a user. To prevent the loops taken by the loop-receiving rod from slipping off from the free end of the shaft, opposite to the needle tip, a thin plate of synthetic plastic material, provided with an axial bore, is slidably positioned on the loop-receiving rod. This axial bore is formed so that the position of the plate on the loop-receiving rod can be adjusted due to the displacement of this plate, whereby friction forces exerted between the plate and the loop-receiving rod would be sufficiently great to prevent the plate from the displacement.

In order to avoid, on the one hand, slipping of the plate from the free end of the loop-receiving rod the latter normally has an upsetting thickening in the form of a node.

It should be noted that the free end of the loop-receiving rod can be easily entangled in the knitted loops of the cloth, which is extremely undesired in hand work. A disk-shaped button at the outer end of the loop-receiving rod has been suggested which acted as a loop brake. However, such a button can itself be caught in the knitted loops, particularly when loops are of great size. If such a button is displaced in the direction of the needle tip in order to shorten the effective length of the loop-receiving rod the node at the end of the rod can be easily entangled in the fine loops. It has been also observed that the centrally positioned axial bore in the disk-shaped button becomes worn out in some time and the fixing of the button at any remaining portion of the loop-receiving rod would be no longer possible. Thus the button would no longer function as a loop brake.

The above mentioned disadvantages of conventional knitting or crochet needles negatively affect the operation of such needles. A further disadvantage of known needles of the foregoing type is the so-called blister packing of the loaded needle. Because the disk-shaped button extends normally to the axis of elongation of the loop-receiving rod the whole needle in its curved position has a considerably great height. The button forms bucklings in the packing formations, which make the suspension of the rows of knitted cloth on the hooks difficult and enlarge packing volumes.

SUMMARY OF THE INVENTION

It is an object of the present invention to provide an improved knitting or crochet needle.

It is another object of the invention to provide a hand needle by means of which a self-entanglement of the free end of the loop-receiving rod would by avoided.

It is yet another object of the invention to provide a hand knitting kneedle which would not require a great deal of space.

These and other objects of the invention are attained by a hand needle for knitting or crochet, comprising a bending-resistant needle tip; a flexible loop-receiving rod connected to said needle tip; and a loop brake displacably positioned on said rod and securable thereon against slipping off a free end of said rod, said loop brake having a through opening for receiving said rod therethrough, said through opening being a radial opening, said loop brake further including at least one recess radially extended therein for receiving the end of said rod.

The loop-receiving rod may preferably have a diameter which is smaller than that of said needle tip.

While in conventional knitting needles the through opening extends axially of the loop brake and the loop brake extends perpendicularly to the axis of elongation of the loop-receiving rod the loop-receiving rod in the present invention penetrates the loop brake radially so that the loop brake and the rod practically lie in the same plane. The curved needle therefore has a relatively small height so that the loaded needle does not require a lot of space.

Since the loop brake does not protrude radially at all the sides of the loop-receiving rod but in fact lies in the same plane with the latter the entanglement of the end of the rod in the knitted loops is hardly possible when the loop brake is positioned at the rear end of the rod. If the loop brake is displaced in the direction of the needle tip there is a possibility due to the radially extending recess, provided in the loop-receiving rod for receiving the end of the rod, that the end of the rod would be secured to the loop brake so that a non-used portion of the rod would form a loop at the loop brake. Such a loop would not be caught in the knitted rows of the cloth.

The hand needle of this invention is specifically easy to handle when the loop brake is a ring-shaped element in a side wall in which said radial bore is provided, said element having an upper side at which said recess is formed, said recess being narrowed at an upper surface of said element, the width of a narrowed portion of said recess being smaller than the diameter of said loop-receiving rod.

The loop brake may be made of synthetic plastic or any other suitable material, for example die cast metal. Such a loop brake is inexpensive to manufacture.

If the loop brake is adjusted, for example in the middle portion of the rod which in turn is provided with a thickening at the end thereof the end of the rod is pushed through said narrowed portion into the radial recess so that the thickening for example module is supported in the ring-shaped element and is therefore no longer damaged.

Needles of the foregoing type having conventional loop-receiving rods are dificultly bendable when the radii of curvature are small. Due to the invention the ring-shaped element has another side wall opposing to said side wall in which said radial bore is provided, and a plurality of said recesses may be formed in said another side wall, at least one of said recesses being disaligned with said radial bore, whereby the portion of the rod extended outwardly from the radial bore can be snapped in the non-aligned recess and the portion of the rod between the bore and the recess can be strongly curved while friction forces between the loop brake and the rod will increase. Wearing-out of the loop brake according to the invention can be practically precluded.

The loop brake at a side thereof facing siad needle tip may have a flattening.

The provision of the flattening ensures a smooth laying of the first loop onto the coop brake and prevents widening of the loops.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figures 1, 2, 3, 4, 5:
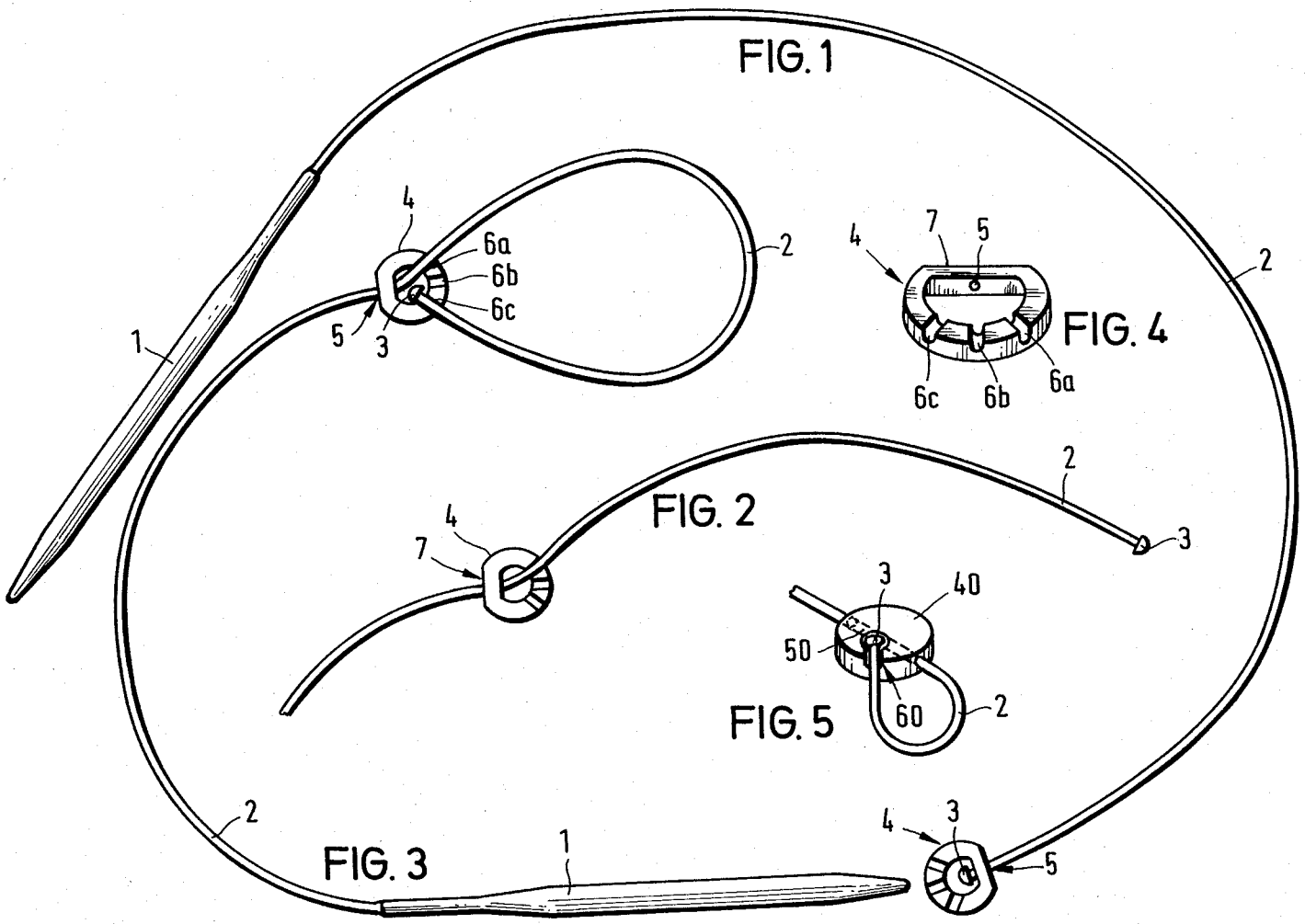
FIG. 1 is view of a hand needle for knitting or crochet works, provided with a loop brake at the free end of a loop-receiving shaft, according to the invention.
FIG. 2 is a rear section of the loop-receiving shaft, at which the loop brake is located at the place remote from the end of the shaft while the end of the shaft is free.
FIG. 3 is a view of the hand needle in which the loop brake is secured in the middle of the loop-receiving shaft while the free end of the shaft is connected to the loop brake.
FIG. 4 is a perspective view of the loop brake shown in FIGS. 1 to 3.
FIG. 5 is a partial view of the needle according to a further embodiment of the invention.

Referring now to the drawings in detail and firstly to FIG. 1 thereof, it will be seen that the needle for hand works of the invention includes a tip 1 formed of metal, for example aluminum, steel or brass, or plastics, and having a front narrowing tip-like end and a rear, also narrowing end. A loop-taking or receiving rod or shaft 2 made, for example of NYLON cord, is secured to the rear end of the tip 1. A thickening in the form of an upsetting node 3 is provided at the rear end of the rod or shaft 2.

Also at the rear end of the loop-receiving shaft 2 of FIG. 1 is positioned a loop brake 4 formed as a ring-shaped element. The loop brake is secured from side-slipping from the loop-receiving shaft 2 by the node 3.

As shown in FIG. 4, the loop brake or ring-shaped element 4 has a radial bore 5 in one of the walls thereof. The diameter of this bore is somewhat greater than the diameter of the loop-taking shaft 2. As shown in FIG. 1 the loop brake 4 is loosely positioned at the end of the loop-receiving shaft 2. The ring-shaped element 4 is provided in the region of bore 5 with a flattening 7 which serves the purpose of holding the first loop the knitted or crochet portion.

Three radially extended grooves or recesses *6a, 6b* and *6c* are formed at the ring-shaped portion of the element 4, lying opposite to the radial bore 5. Although not shown in the drawings the radial grooves *6a, 6b, 6c* have not exactly U-shaped cross-section but rather have the cross-section of the upwardly opened "O" so that in the embodiment of FIG. 4 each radial groove has a narrow portion at the upper side thereof. The width of this narrow portion is somewhat smaller than the diameter of the loop-receiving rod so that the end of the rod pressed into such a groove is reliably held in that groove.

Should the loop brake be secured at the spot of the loop-receiving rod remote from the free end of the shaft, as shown in FIG. 2, then the portion of rod 2, penetrating the radial bore 5 would be held in one of two radial grooves which are not in alignment with bore 5. Inasmuch as the loop-receiving rod 2 can be deformed with small curvature radii only with great efforts and therefore it tends to stretch, the loop brake 4 is clamped at such buckled or bent portion as depicted in FIG. 2.

The upsetting node 3 at the end of the loop-receiving shaft 2 can not be thus entangled or caught in the knitted loops and the rear free end of the shaft would be bent into a loop while the end in the region of the nodule 3 would be snapped in one of the free grooves.

Various modifications of the above described embodiment are possible. For example, the radial grooves can be alternatively arranged at both sides of the ring-shaped element 4. The loop brake can be also formed as a plate-shaped disc of a substantially circular cross-section as shown in the embodiment of FIG. 5. In this embodiment, the loop brake is a disc 40 which has a radial bore 50 in the middle thereof. The rod 2 extends through bore 50. A radial groove 60, which is open upwardly is formed at the side of disc 40. The nodle 3 at the end of the loop-receiving rod 2 can be snapped in the radial groove 60 in the same manner as has been described above for the embodiment of FIG. 4.

In order to manufacture the hand work-needle of the present invention the free end of the loop-receiving rod 2 is guided through the axial bore before, the end of the shaft has been provided with the nodule 3 by the heat treatment or any other suitable process so as to make a thickening at this end of the shaft.

As can be seen from the drawings the height of the needle is defined in the stretched and rolled-in positions only by the thickness of the tip or needle 1 or in the case of a very thin needles, by the technically-conditioned medium height of the ring-shaped element; then the height of the ring-shaped element 4 or disc 40 is smaller than the diameter of the tip 1.

It will be understood that each of the elements described above, or two or more together, may also find a useful application in other types of hand needles for knitting or crochet differing from the types described above.

While the invention has been illustrated and described as embodied in a hand needle for knitting or crochet, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fiarly constitute essential characteristics of the generic or specific aspects of this invention.

What is claimed as new and desired to be protected by Letters Patent is set forth in the appended claims:

1. A hand needle for knitting or crochet, comprising a bending-resistant needle tip; a flexible loop-receiving rod connected to said needle tip; and a loop brake displaceably positioned on said rod and securable thereon against slipping off a free end of said rod, said loop brake having a through opening for receiving said rod therethrough, said through opening being a radial opening, said loop brake further including at least one recess radially extended therein for receiving the end of said rod.

2. The needle as defined in claim 1, wherein said loop-receiving rod has a diameter which is smaller than that of said needle tip.

3. The needle as defined in claim 2, wherein said loop brake is a ring-shaped element in a side wall in which said radial bore is provided, said element having an upper side at which said recess is formed, said recess being narrowed at an upper surface of said element, the width of a narrowed portion of said recess being smaller than the diameter of said loop-receiving rod.

4. The needle as defined in claim 1, wherein said end of said rod has a thickening.

5. The needle as defined in claim 3, wherein said ring-shaped element has another side wall opposing to said side wall in which said radial bore is provided, a plurality of said recesses being formed in said another side wall, at least one of said recesses being disaligned with said radial bore.

6. The needle as defined in claim 4, wherein said loop brake at a side thereof facing said needle tip has a flattening.

7. The needle as defined in claim 2, wherein said loop brake is disc-shaped and has an upper side at which said recess is formed, said recess being narrowed at an upper surface of the loop brake.

* * * * *